US005605279A

United States Patent [19]

Adamek

[11] Patent Number: 5,605,279

[45] Date of Patent: Feb. 25, 1997

[54] CARTON FOR CARRY-OUT TYPE FOOD

[75] Inventor: David J. Adamek, River Falls, Wis.

[73] Assignee: Flour City Packaging Corporation, Minneapolis, Minn.

[21] Appl. No.: 554,255

[22] Filed: Nov. 6, 1995

[51] Int. Cl.[6] ..... B65D 5/20; B65D 5/64

[52] U.S. Cl. ..... 229/116.1; 229/112; 229/117; 229/155; 229/904; 229/906

[58] Field of Search ..... 229/112, 117, 229/116.1, 155, 164, 902, 904, 906, 125.42, 108; 220/738; 426/115

[56] References Cited

U.S. PATENT DOCUMENTS

| | | | |
|---|---|---|---|
| 720,345 | 2/1903 | Hazeltine | 229/108 |
| 1,697,664 | 1/1929 | Schweich | 229/108 |
| 2,616,610 | 11/1952 | Tomarin | 229/108 |
| 2,701,089 | 2/1955 | Fischer | 229/164 |
| 3,166,235 | 1/1965 | Schroeder | 229/902 |
| 4,363,400 | 12/1982 | Lewis | 229/155 |
| 4,497,433 | 2/1985 | Wischusen, III | 229/904 |
| 4,699,312 | 10/1987 | Owen | 229/112 |
| 5,069,385 | 12/1991 | Fasber | 229/125.42 |
| 5,322,211 | 6/1994 | Petersen | 229/125.42 |
| 5,326,024 | 7/1994 | Fogle | 229/125.42 |

FOREIGN PATENT DOCUMENTS

| | | | |
|---|---|---|---|
| 1097283 | 3/1981 | Canada | 229/112 |
| 3402096 | 8/1985 | Germany | 229/125.42 |
| 1251071 | 10/1971 | United Kingdom | 229/125.42 |

*Primary Examiner*—Gary E. Elkins

*Attorney, Agent, or Firm*—Merchant, Gould, Smith, Edell, Welter & Schmidt, P.A.

[57] ABSTRACT

A disposable carton accommodates food and drinks of a type commonly associated with fast food restaurants and spectator events. The carton includes a bottom and sidewalls which cooperate to form an upwardly opening box configuration. Overlapping top panels are selectively interconnected to partially enclose the carton. At least one skewed intermediate panel is disposed between a sidewall and a top panel.

18 Claims, 7 Drawing Sheets

CARTON FOR CARRY-OUT TYPE FOOD

FIELD OF THE INVENTION

The present invention relates to packaging and more particularly, to a lightweight carton suitable for carrying ready-to-consume foods and/or beverages from a point of purchase.

BACKGROUND OF THE INVENTION

The success of a product can be a function (at least in part) of the product's packaging, by reason of the consumer appeal of the packaging, the effectiveness of the packaging, etc. In the fast food restaurant business, the McDonald's Happy Meal is an example of successful packaging. For the record, a McDonald's Happy Meal is a children's meal that comes in a colorfully designed cardboard carton and generally includes a hamburger, a bag of french fries, and a small toy, as well as a cup of soda pop. The McDonald's Happy Meal is exemplary of numerous children's meal combinations or packages now being offered by fast food restaurants.

Similar sorts of fast food and beverages are typically offered at spectator events, though sometimes in less spectacular packaging. Since the consumers of this food are presumably in attendance to watch a live event or performance, they often want to purchase food and/or beverages and return to their seat before consuming same. To accommodate this desire, vendors often provide cardboard cartons suitable for holding combinations of food and beverages. For example, one such carton may provide a pair of holes on each end to support beverage cups, and an intermediate compartment to hold a serving of nachos.

In view of the large numbers of cartons used everyday to carry "fast foods" and the possible impact of the cartons on the success of the products themselves, a continual need exists to improve such cartons, making them as effective and yet, as inexpensive as possible.

SUMMARY OF THE INVENTION

A preferred embodiment of the present invention provides a carton that is suitable for carrying "fast foods" away from a point of purchase. The carton is particularly well suited to function as a Happy Meal container, though it is not specifically limited to this application.

The preferred embodiment carton includes side walls and an "auto bottom" which allows the carton to readily transformed between a three dimensional box and a substantially two dimensional configuration suitable for shipping and storage. As a three dimensional box, the carton includes top panels that selectively interconnect to enclose a forward portion of the carton and thereby provide a compartment suitable for containing a hamburger, a bag of french fries, and a small toy. A rearward portion of the carton remains upwardly opening and thus provides a compartment suitable for containing a beverage cup.

The carton is cost effective to manufacture and effective in use. In particular, the carton may be constructed from a single, continuous sheet of cardstock. Also, the carton includes at least one wall or panel that is skewed relative to the orthogonal axes of the box and thereby enhances the structural integrity of same. The top panels not only open and close with relative ease, but also include flaps that tend to maintain the beverage in an upright orientation. These advantages and others will become apparent to those skilled in the art upon a more detailed description of the preferred embodiment.

BRIEF DESCRIPTION OF THE FIGURES OF THE DRAWING

With reference to the Figures of the Drawing, wherein like numerals represent like parts and assemblies throughout the several views.

DETAILED DESCRIPTION OF THE PREFERRED EMBODIMENT

A preferred embodiment carton constructed according to the principles of the present invention is designated as 100 in FIGS. 1–7. The carton 100 includes an exterior surface 101 and an interior surface 102. The carton 100 may be manufactured from a sheet of card stock 100' cut as shown in FIG. 8 and then manipulated to arrive at the configuration shown in FIGS. 1–7. The carton 100 provides a compartment or containment space 103 having an enclosed forward portion and an upwardly opening rearward portion.

Figure 3:
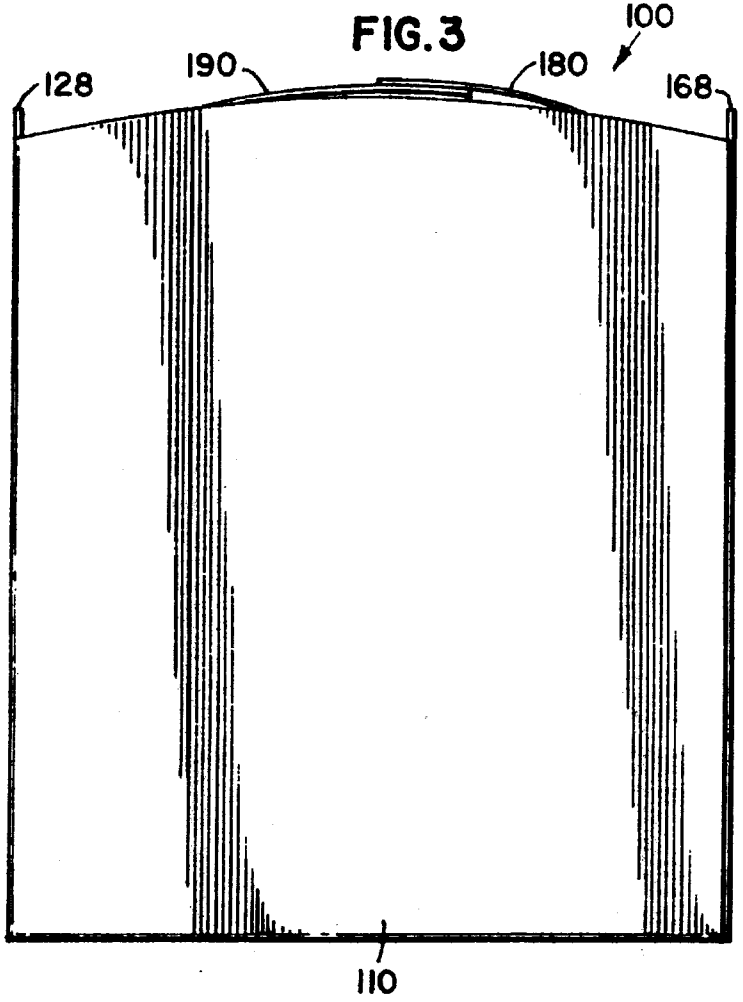
FIG. 3 is a rear view of the preferred embodiment carton shown in FIG. 1.
Figure 4:
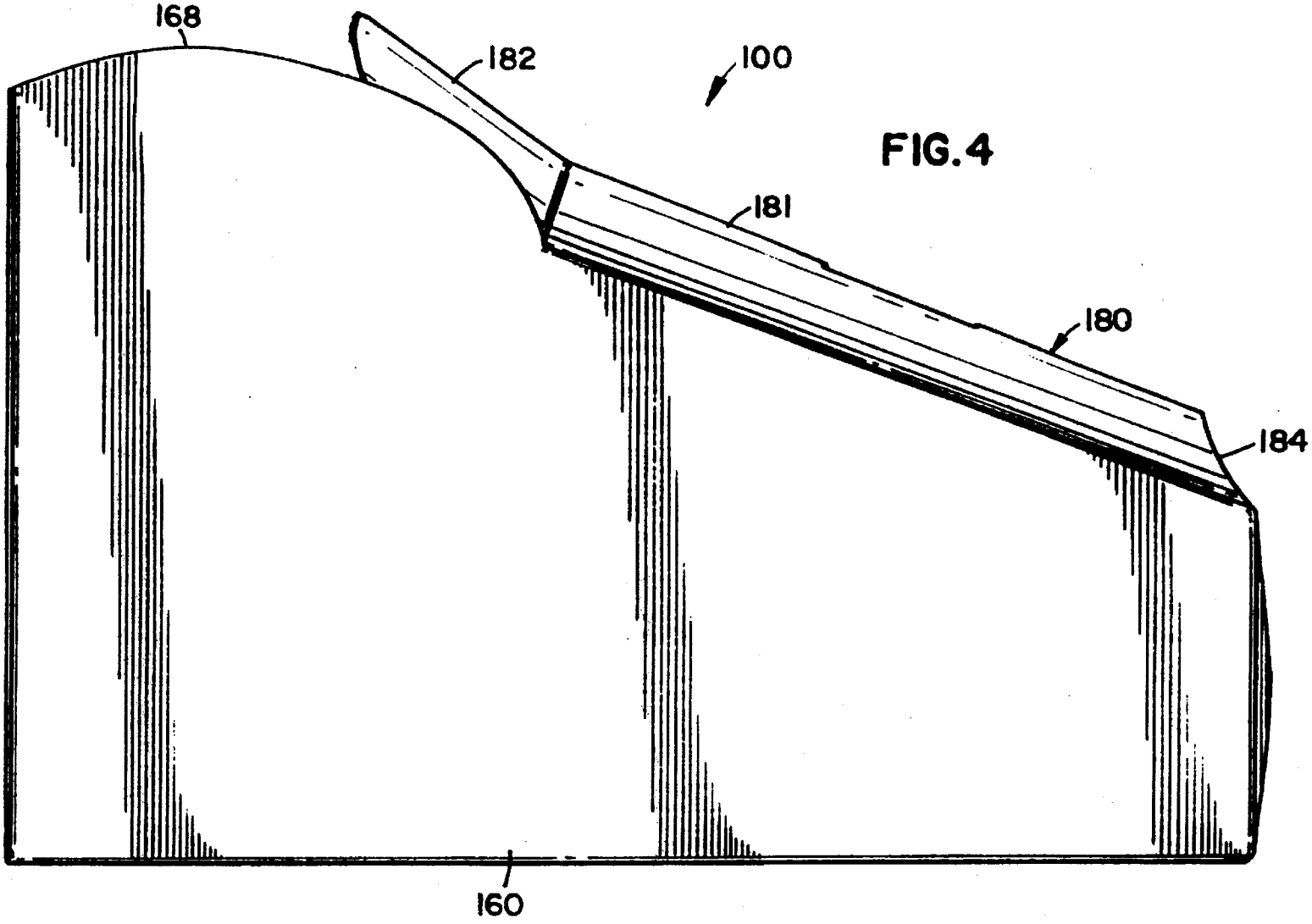
FIG. 4 is a left side view of the preferred embodiment carton shown in FIG. 1.

As shown primarily in FIGS. 3 and 8, the carton 100 includes a back panel 110 which is generally rectangular in shape. The back panel 110 is integrally joined to a right side panel 120 along a fold line 112. The back panel 110 includes a distal edge 111 which is opposite the fold line 112 and extends substantially parallel thereto. An upper edge 118 extends in a moderate arc between upper ends of the distal edge 111 and the fold line 112. The back panel is also integrally joined to a first bottom panel 210 along a fold line 212, which is opposite the upper edge 118. The fold line 212 extends between lower ends of the distal edge 111 and the fold line 112 and substantially perpendicular thereto.

Figure 1:
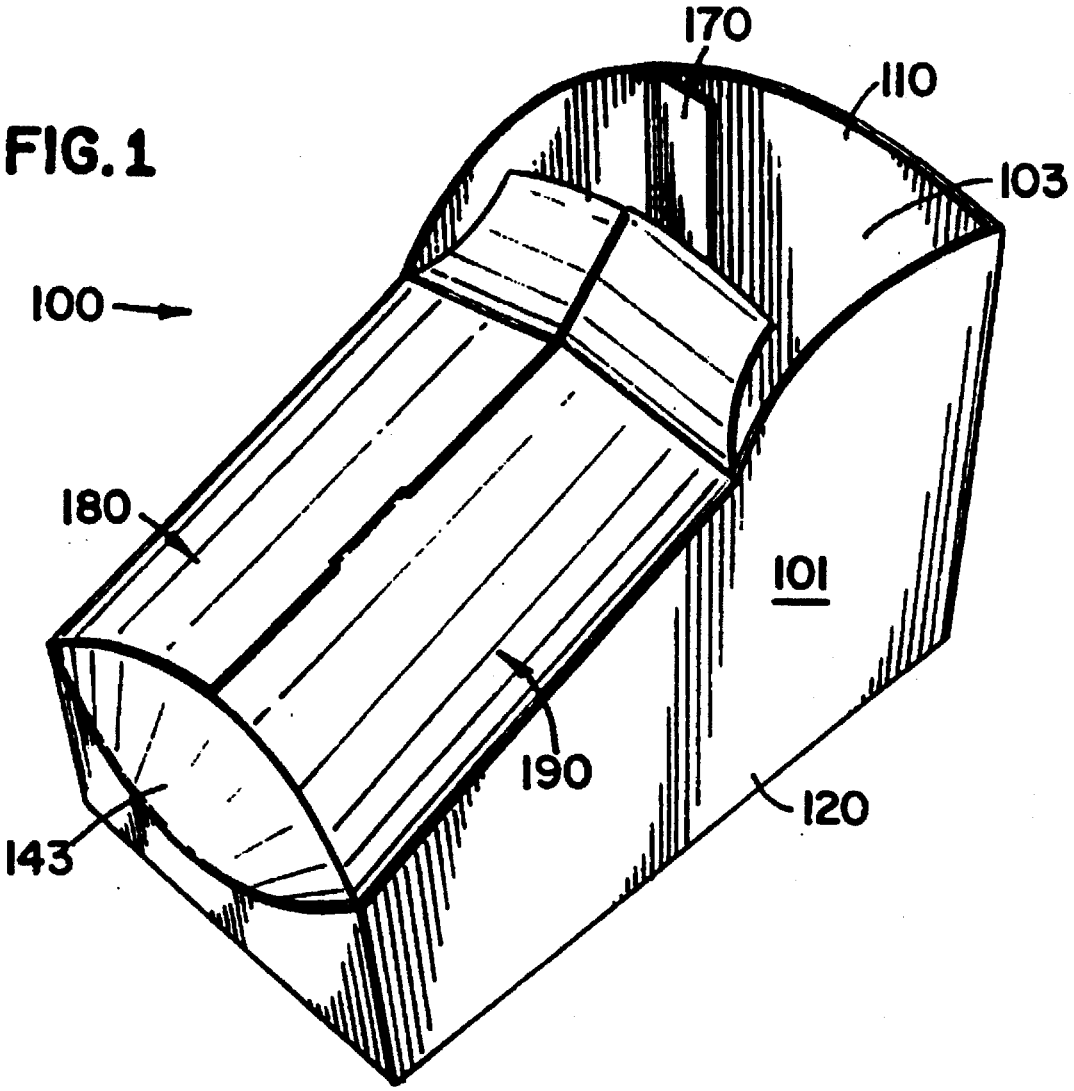
FIG. 1 is a perspective view of a preferred embodiment carton constructed according to the principles of the present invention.
Figure 5:
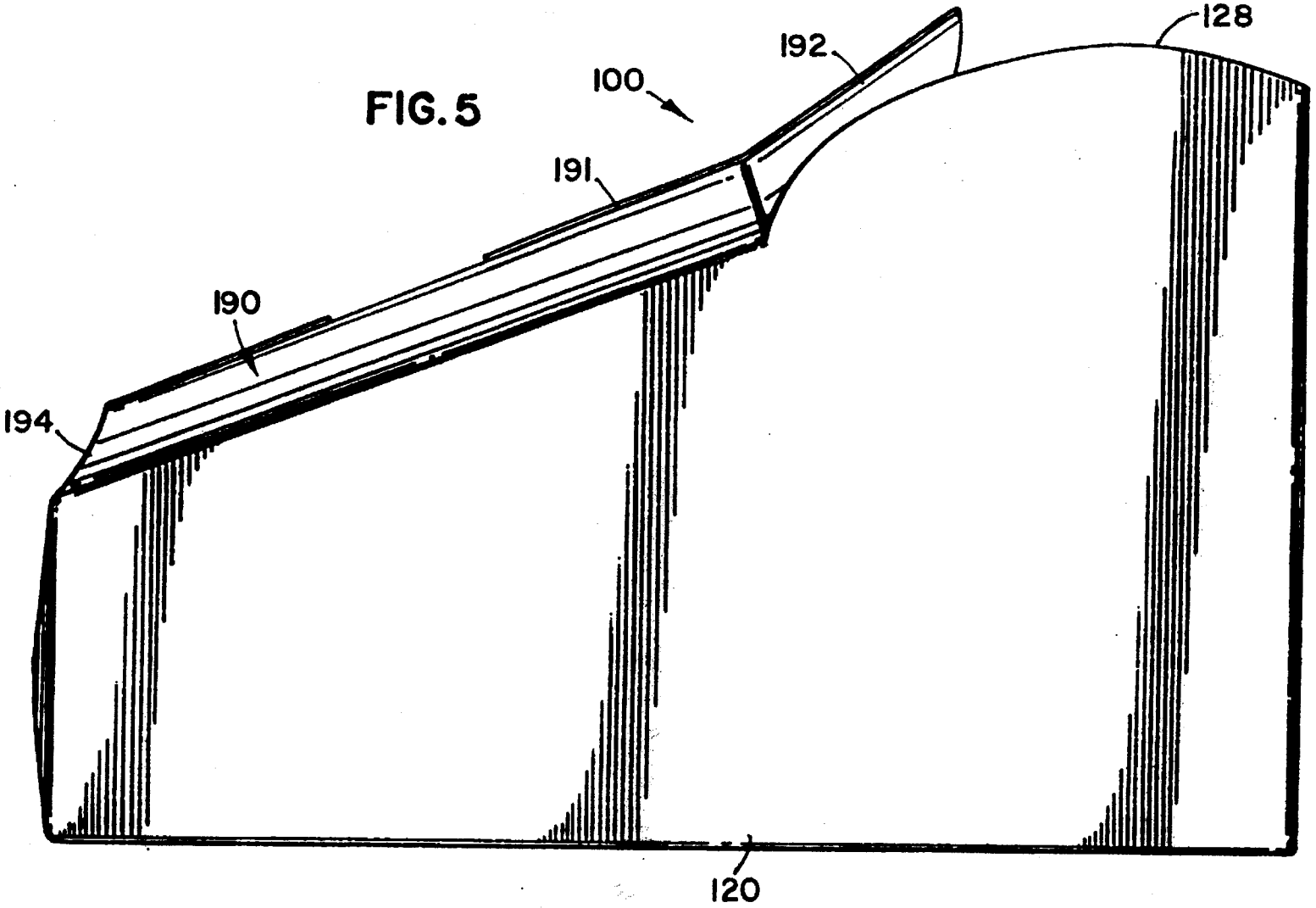
FIG. 5 is a right side view of the preferred embodiment carton shown in FIG. 1.

As shown primarily in FIGS. 1, 5, and 8, the right side panel 120 has a shape that generally corresponds to the profile of a "high-top" athletic shoe. The right side panel 120 is integrally joined to a front panel 140 along a fold line 122 which extends substantially parallel to the fold line 112. The right side panel 120 is also integrally joined to a second bottom panel 220 along a fold line 222, which extends between lower ends of the fold lines 112 and 122 and substantially perpendicular thereto. The right side panel 120 is also integrally joined to a first top panel 190 along a fold line 129, which extends from an upper end of the fold line 122 and at an obtuse angle relative thereto. A curved upper edge 128 extends from an opposite end of the fold line 129 to the juncture between the fold line 112 and the arcuate upper edge 118. The curved upper edge 128 includes a cut 109 between the right side panel 120 and the first top panel 190.

Figure 2:
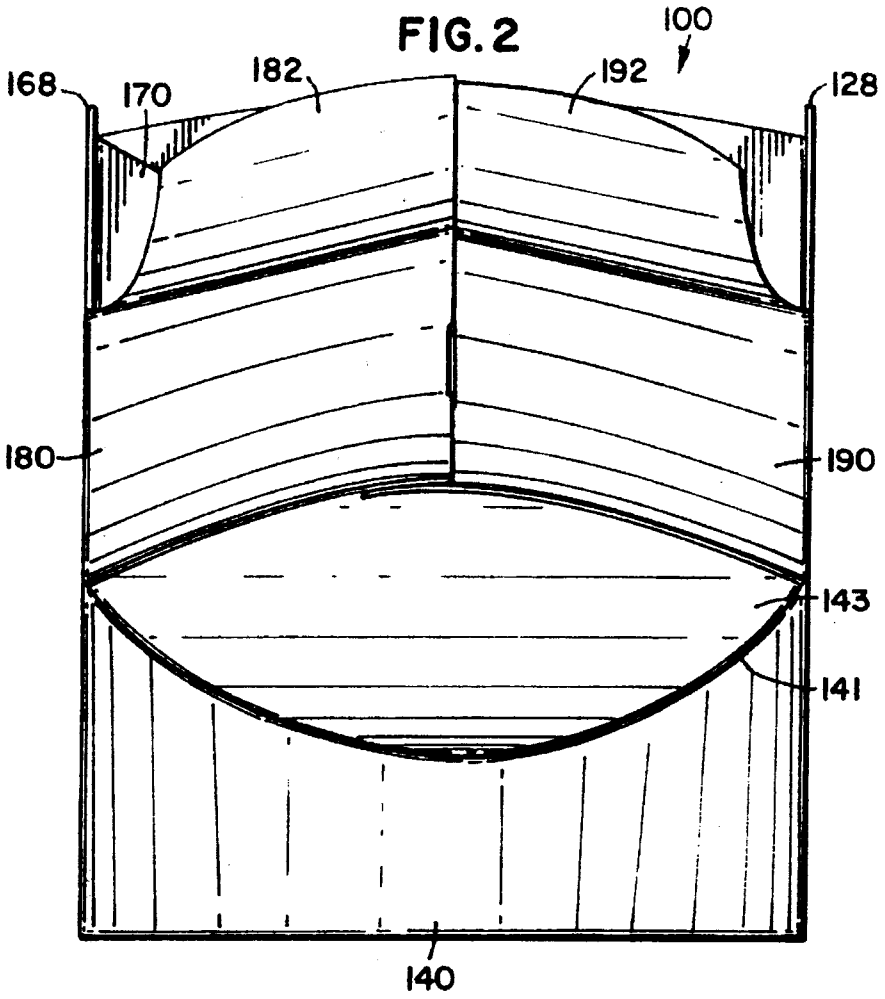
FIG. 2 is a front view of the preferred embodiment carton shown in FIG. 1.

As shown primarily in FIGS. 1, 2, and 8, the front panel 140 has a shape that may be described generally as an inverted arch. The front panel 140 is integrally joined to a left side panel 160 along a fold line 142 which extends substantially parallel to the fold line 122. The front panel 140 is also integrally joined to a third bottom panel 240 along a fold line 242, which extends between lower ends of the fold lines 122 and 142 and substantially perpendicular thereto. The front panel 140 is also integrally joined to an intermediate panel 143 along an arcuate fold line 141 which extends between upper ends of the fold lines 122 and 142.

The left side panel 160 is similar in size and shape to the right side panel 120. Thus, as shown primarily in FIGS. 4 and 8, the left side panel 160 also has a shape that generally corresponds to the profile of a "high-top" athletic shoe. The left side panel 160 is integrally joined to an overlap panel 170 along a fold line 162 which extends substantially parallel to the fold line 142. The left side panel 160 is also integrally joined to a fourth bottom panel 260 along a fold line 262, which extends between lower ends of the fold lines 142 and 162 and substantially perpendicular thereto. The left side panel 160 is also integrally joined to a second top panel 180 along a fold line 169, which extends from an upper end of the fold line 142 and at an obtuse angle relative thereto. A curved upper edge 168 extends from an opposite end of the fold line 169 to an upper end of the fold line 162. The curved upper edge 168 includes a cut 108 between the left side panel 160 and the second top panel 180.

The overlap panel 170 is shaped as a trapezoid with the fold line 162 defining the longer parallel side thereof. The overlap panel 170 includes a distal edge 171 which is opposite the fold line 162 and extends substantially parallel thereto. A lower edge 173 of the overlap panel 170 extends linearly between lower ends of the fold line 162 and the distal edge 171, at an acute angle relative to the former (and thus, an obtuse angle relative to the latter). An upper edge 178 of the overlap panel 170 extends linearly between upper ends of the fold line 162 and the distal edge 171, at an acute angle relative to the former (and thus, an obtuse angle relative to the latter). The upper edge 178 is a substantially continuous linear extension of the curved upper edge 168 on the left side panel 160. An adhesive 179 is applied to the exterior of the overlap panel 170 for purposes of assembly, as explained below in greater detail.

Figure 6:
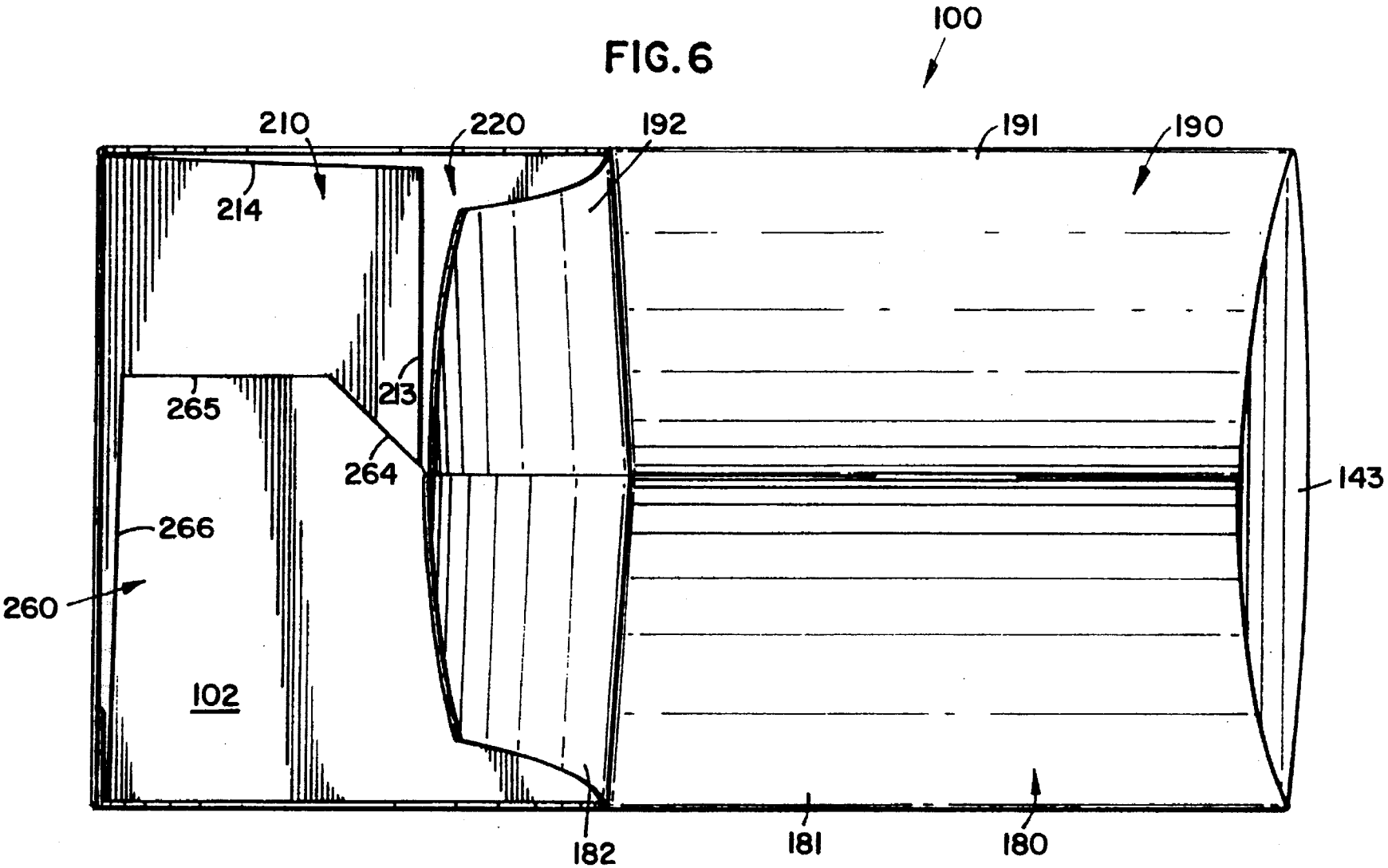
FIG. 6 is a top view of the preferred embodiment carton shown in FIG. 1.
Figure 7:
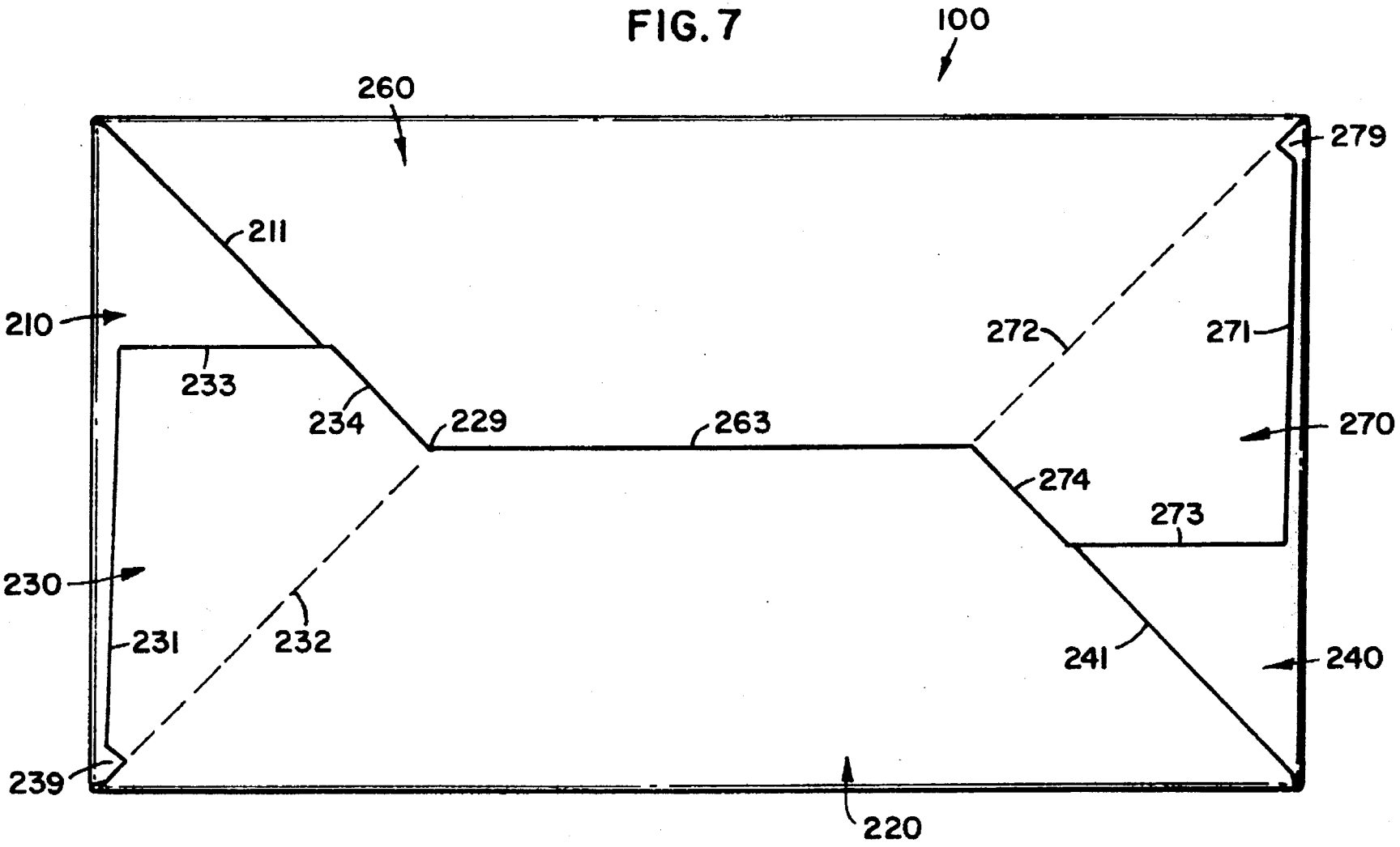
FIG. 7 is a bottom view of the preferred embodiment carton shown in FIG. 1.
Figure 8:
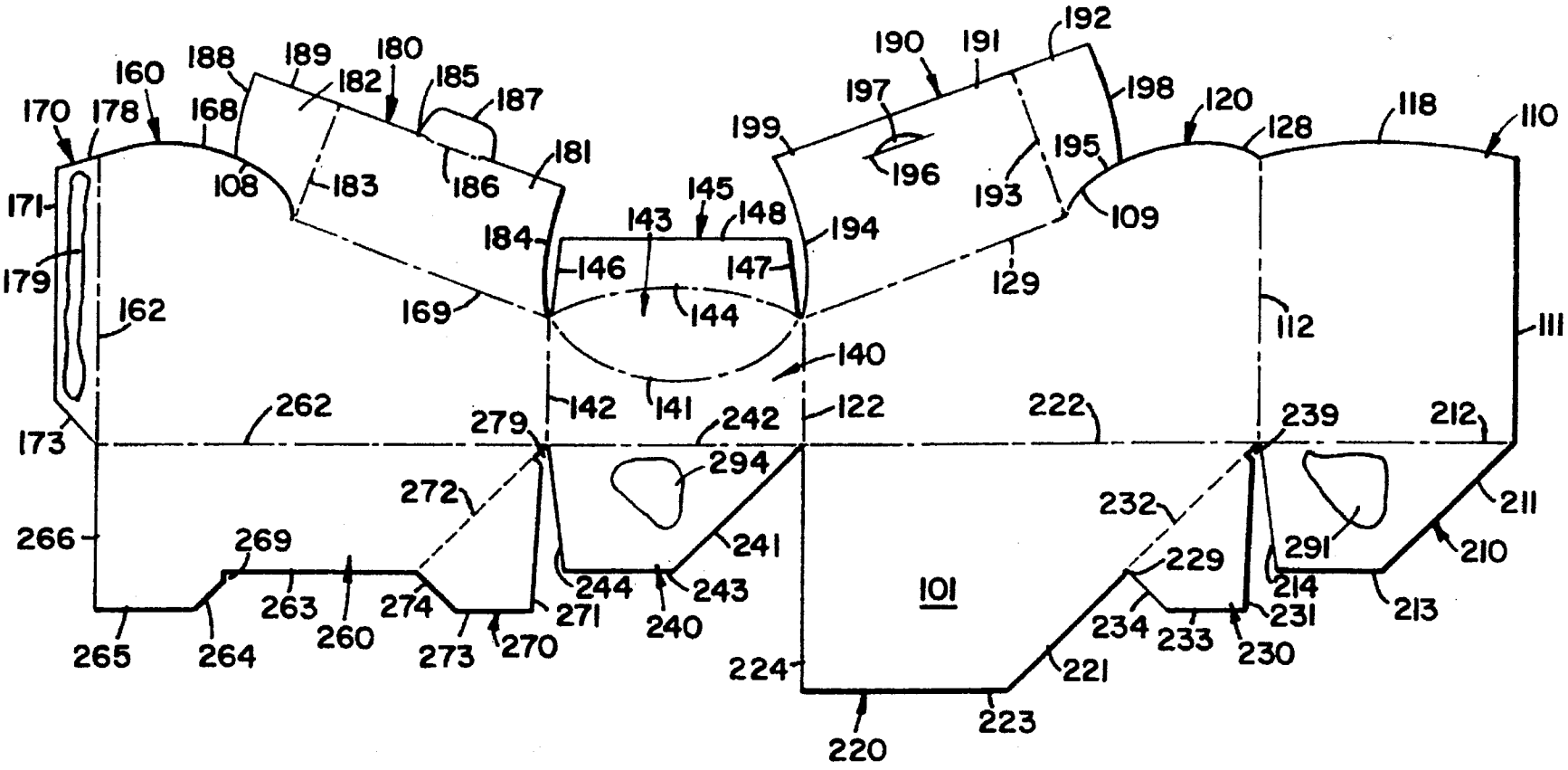
FIG. 8 is a plan view of an exterior face of card stock that may be manipulated into the preferred embodiment carton shown in FIG. 1 by folding and adhering portions thereof relative to one another.

As shown primarily in FIGS. 6–8, the first bottom panel 210 is shaped as a trapezoid with the fold line 212 defining the longer parallel side thereof. The first bottom panel 210 includes an outer edge 213 which is opposite the fold line 212 and extends substantially parallel thereto. A left edge 211 of the first bottom panel 210 extends between respective left ends of the fold line 212 and the outer edge 213, defining angles of approximately forty-five degrees and one hundred and thirty-five degrees relative to the former and the latter, respectively. A right edge 214 of the first bottom panel 210 extends between respective right ends of the fold line 212 and the outer edge 213, defining angles of approximately eighty-five degrees and ninety-five degrees relative to the former and the latter, respectively. An adhesive 291 is applied to an intermediate portion of the exterior of the first bottom panel 210 for purposes of assembly, as explained below in greater detail.

As shown primarily in FIGS. 6–8, the second bottom panel 220 is shaped as a trapezoid with the fold line 222 defining the longer parallel side thereof. The second bottom panel 220 includes an outer edge 223 which is opposite the fold line 222 and extends substantially parallel thereto. A front edge 224 of the second bottom panel 220 extends from the front end of the fold line 222 to the front end of the outer edge 223 and substantially perpendicular thereto. A rear edge 221 of the second bottom panel 220 extends from the rear end of the outer edge 223 toward the rear end of the fold line 222, defining angles of approximately one hundred and thirty-five degrees and forty-five degrees relative to the former and the latter, respectively.

A fifth bottom panel 230 is integrally joined to the second bottom panel 220 along a fold line 232, which extends from the rear end of the fold line 222 toward the rear end of the outer edge 223. In other words, the fold line 232 is a co-linear extension of the rear edge 221 of the second bottom panel 220. The fifth bottom panel 230 is shaped as a quadrilateral. The fifth bottom panel 230 includes an outer edge 233 which is opposite the fold line 222 and extends substantially parallel thereto. A front edge 234 of the fifth bottom panel 230 extends from the front end of the outer edge 233 to the juncture between the fold line 232 and the rear edge 221 of the second bottom panel 220 and generally perpendicular thereto. A rear edge 231 of the fifth bottom panel 230 extends from the rear end of the outer edge 233 toward the rear end of the fold line 222 and generally perpendicular thereto. A generally triangular notch 239 is formed in the fifth bottom panel 230 proximate the juncture between the rear edge 231 and the fold line 232.

As shown primarily in FIGS. 6–8, the third bottom panel 240 is similar in size and shape to the first bottom panel 210. The third bottom panel 240 is likewise shaped as a trapezoid with the fold line 242 defining the longer parallel side thereof. The third bottom panel 240 includes an outer edge 243 which is opposite the fold line 242 and extends substantially parallel thereto. A right edge 241 of the third bottom panel 240 extends between respective right ends of the fold line 242 and the outer edge 243, defining angles of approximately forty-five degrees and one hundred and thirty-five degrees relative to the former and the latter, respectively. A left edge 244 of the third bottom panel 240 extends between respective left ends of the fold line 242 and the outer edge 243, defining angles of approximately eighty-five degrees and ninety-five degrees relative to the former and the latter, respectively. An adhesive 294 is applied to an intermediate portion of the exterior of the third bottom panel 240 for purposes of assembly, which is explained below in greater detail.

As shown primarily in FIGS. 6–8, the fourth bottom panel 260 includes an outer edge 263 which is opposite the fold line 262 and extends substantially parallel thereto. A rear edge 266 of the fourth bottom panel 260 extends from the rear end of the fold line 262 and substantially perpendicular thereto. Another outer edge 265 of the fourth bottom panel 260 extends from an opposite end of the rear edge 266 and substantially perpendicular thereto. A connecting edge 264 extends from an opposite, front end of the other outer edge 265 and toward the rear end of the outer edge 263, defining angles of approximately one hundred and thirty-five degrees relative to each. A generally triangular notch 269 is formed in the fourth bottom panel 260 proximate the juncture between the outer edge 263 and the connecting edge 264.

A sixth bottom panel 270 is integrally joined to the fourth bottom panel 260 along a fold line 272, which extends between respective front ends of the fold line 262 and the outer edge 263 of the fourth bottom panel 260. The sixth bottom panel 270 is similar in size and shape to the fifth bottom panel 230. The sixth bottom panel 270 likewise includes an outer edge 273 which is opposite the fold line 262 and extends substantially parallel thereto. A rear edge 274 of the sixth bottom panel 270 extends from the rear end of the outer edge 273 to the juncture between the fold line 272 and the outer edge 262 and generally perpendicular to the latter. A front edge 271 of the sixth bottom panel 270 extends from the front end of the outer edge 273 toward the front end of the fold line 262 and generally perpendicular thereto. A generally triangular notch 279 is formed in the sixth bottom panel 270 proximate the juncture between the front edge 271 and the fold line 272.

The first top panel 190 is generally rectangular in shape. As discussed above, the first top panel 190 is integrally joined to the right side panel 120 along the fold line 129, which extends from an upper end of the fold line 122 and at an obtuse angle relative thereto. The first top panel 190 includes an outer edge 199 which is opposite the fold line 129 and extends generally parallel thereto. A curved forward edge 194, which may be described as rearwardly convex, extends between forward ends of the outer edge 199 and the fold line 129.

The cut 109 between the right side panel 120 and the first top panel 190 defines a curved lower edge 195 of the first top panel 190, as well as a portion of the curved upper edge 128 of the right side panel 120. A curved rearward edge 198, which may also be described as rearwardly convex, extends between rearward ends of the lower edge 195 and the fold line 129. A fold line 193 extends away from the juncture between the fold line 129 and the cut 109 and generally perpendicular to the former. The fold line 193 separates the first top panel 190 into a first or forward flap 191 and a second or rearward flap 192. The forward flap 191 is bordered by the fold line 193, the fold line 129, the forward edge 194, and the portion of the outer edge 199 extending between the forward edge 194 and the fold line 193. The rearward flap 192 is bordered by the rearward edge 198, the lower edge 195, the fold line 193, and the portion of the outer edge 199 that extends between the fold line 193 and the rearward edge 198.

A third top panel 145 is integrally joined to the intermediate panel 143 along an arcuate fold line 144 which extends between upper ends of the fold lines 122 and 142. Recognizing that the fold line 141 likewise extends between the upper ends of the fold lines 122 and 142, the intermediate panel 143 is defined between these two arcuate fold lines 141 and 144, which may be described as concave relative to one another. The third top panel 145 includes opposite edges 146 and 147 which extend in slightly convergent fashion from the upper ends of the fold lines 142 and 122, respectively. An outer edge 148 extends between upper ends of the opposite edges 146 and 147, generally opposite the fold line 144. The outer edge 148 extends generally parallel to the fold line 242 that separates the front panel 140 and the third bottom panel 240. The third top panel 145 and the intermediate panel 143 cooperate to define a forward top panel.

The second top panel 180 is generally similar in size and shape to the first top panel 190. Thus, the second top panel 180 is likewise generally rectangular in shape. As discussed above, the second top panel 180 is integrally joined to the left side panel 160 along the fold line 169, which extends from an upper end of the fold line 142 and at an obtuse angle relative thereto. The second top panel 180 includes an outer edge 189 which is opposite the fold line 169 and extends generally parallel thereto. A curved forward edge 184, which may be described as rearwardly convex, extends between forward ends of the outer edge 189 and the fold line 169.

The cut 108 between the left side panel 160 and the second top panel 180 defines a curved lower edge (shown without an accompanying reference numeral) of the second top panel 180, as well as a portion of the curved upper edge 168 of the left side panel 160. A curved rearward edge 188, which may also be described as rearwardly convex, extends between rearward ends of the lower edge (not numbered) and the fold line 169. A fold line 183 extends away from the juncture between the fold line 169 and the cut 108 and generally perpendicular to the former. The fold line 183 separates the second top panel 180 into a first or forward flap 181 and a second or rearward flap 182. The forward flap 181 is bordered by the fold line 183, the fold line 169, the forward edge 184, and the portion of the outer edge 189 extending between the forward edge 184 and the fold line 183. The rearward flap 182 is bordered by the rearward edge 188, the lower edge (not numbered), the fold line 183, and the portion of the outer edge 189 that extends between the fold line 183 and the rearward edge 188.

A tab or tongue 187 is integrally joined to the forward flap 181 of the second top panel 180 along a fold line 186, which is disposed slightly inside the outer edge 189 and extends generally parallel thereto. Generally arcuate cuts 185 extend between respective ends of the outer edge 189 and the fold line 186. The tab 187 is approximately centered relative to the midpoint along the forward flap 181.

Designed to cooperate with the tab 187, a linear slot 196 is formed in the forward flap 191 of the first top panel 190. The slot 196 is disposed approximately one-half inch inside the outer edge 199 and extends generally parallel thereto. An arcuate slot (shown without an accompanying reference numeral) is also formed in the forward flap 191. The ends of the arcuate slot (not numbered) intersect discrete intermediate points on the linear slot 196 and thereby define an opening 197. The slot 196 and the opening 197 are approximately centered relative to the midpoint along the forward flap 191.

Assembly of the carton 100 requires that the first bottom panel 210 be folded relative to the rear panel 110 along the fold line 212, and in such a manner that normal lines extending away from the interior surface of each are capable of intersecting one another. In like manner along respective fold lines, the second bottom panel 220 is folded relative to the right side panel 120; the third bottom panel 240 is folded relative to the front panel 140; and the fourth bottom panel 260 is folded relative to the left side panel 160.

Assembly of the carton 100 further requires that the rear panel 110 be folded relative to the right side panel 120 along the fold line 112, and again, in such a manner that normal lines extending away from the interior surface of each are capable of intersecting one another. Adhesive 291 is used to connect the exterior face of the first bottom panel 210 to the interior face of the fifth bottom panel 230. In like manner, the front panel 140 is folded relative to the left side panel 160 along the fold line 142, and adhesive 294 is used to connect the exterior face of the third bottom panel 240 to the interior face of the sixth bottom panel 270.

Assembly of the carton 100 further requires that, in like manner and along respective fold lines, the overlap panel 170 be folded relative to left side panel 160; and the right side panel 120 be folded relative to the front panel 140. Adhesive 179 is used to connect the exterior face of the overlap panel 170 to the interior face of the rear panel 110. At this point, the resulting structure is an upwardly opening box that may be described as having an "auto bottom" which allows the box to be readily manipulated between a three dimensional box (suitable for use) and a substantially two dimensional configuration (suitable for storage and shipping).

As shown in FIGS. 6–7, the third bottom panel 240 and the fourth bottom panel 260, as well as the sixth bottom panel 270, are disposed outside the second bottom panel 220. However, the first bottom panel 210 and the fifth bottom panel 230 are disposed outside the fourth bottom panel 260. The bottom collapses along the fold lines 232 and 272 to arrive at the two dimensional configuration. The first bottom panel 210 and the fifth bottom panel 230 fold against the rear panel 110; the second bottom panel 220 folds against the right side panel 120; the third bottom panel 240 and the sixth bottom panel 270 fold against the front panel 140; and the fourth bottom panel 260 folds against the left side panel 160. When the carton 100 is in the folded configuration, the exterior faces of the second bottom panel 220 and the fifth bottom panel 230 face one another, and the exterior faces of the fourth bottom panel 260 and the sixth bottom panel 270 face one another. When the carton 100 is unfolded to arrive at the three dimensional box configuration, the notches 229 and 269 interengage and cooperate to discourage unintentional collapse of the carton 100.

Assembly of the carton 100 further requires that the intermediate panel 143 be folded relative to the front panel 140 along the fold line 141, in like manner though not to the same degree as the other folds described above. The skewed orientation of the intermediate panel 143 relative to the other panels significantly enhances the structural integrity of the carton 100. The third top panel 145 is likewise folded relative to the intermediate panel 143 along the fold line 144.

Assembly of the carton 100 further requires that the first top panel 190 be folded relative to the right side panel 120 along the fold line 129, in such a manner that the interior of the first top panel 190 faces generally toward the interior of the second bottom panel 220. A forward portion of the forward flap 191 overlaps more than half of the third top panel 145, and the forward edge 194 of the first top panel 190 substantially aligns with the fold line 144. The rearward flap 192 is folded relative to the forward flap 191 along the fold line 193, and in a manner contrary to all of the folds described above. In particular, the rearward flap 192 is folded relative to the forward flap 191 in such a manner that normal lines extending away from the exterior surface of each are capable of intersecting one another.

Similar manipulations are performed on the second top panel 180. In particular, the second top panel 180 is folded relative to the left side panel 160 along the fold line 169, in such a manner that the interior of the second top panel 180 faces generally toward the interior of the fourth bottom panel 260. A forward portion of the forward flap 181 overlaps approximately half of the third top panel 145, and the forward edge 184 of the second top panel 180 substantially aligns with the fold line 144. The rearward flap 182 is folded relative to the forward flap 181 along the fold line 193, in such a manner that normal lines extending away from the exterior surface of each are capable of intersecting one another. The rearward flaps 192 and 182 cooperate with the bottom of the carton, the rear panel 110, and rearward portions of the side panels 120 and 160 to provide an upwardly opening compartment suitable for holding a beverage container comparable to the type included in a McDonald's Happy Meal. The rearward flaps 192 and 182 resiliently deflect to accommodate and retain such a container.

The tab 187 and the opening 197 cooperate to provide a means for selectively connecting the second top panel 180 and the first top panel 190 relative to one another to partially enclose the carton 100. In particular, the linear slot 196 in the first top panel 190 receives the tab 187 on the second top panel 180, and the arcuate edge of the opening 197 in the first top panel 190 releasably interengages the arcuate slots 185 in the second top panel 180. In this configuration, the forward flaps 191 and 181 cooperate with the bottom of the carton, the third top panel 145, the intermediate panel 143, the front panel 140, and forward portions of the side panels 120 and 160 to provide a substantially enclosed compartment suitable for holding food and a toy comparable to those included in a McDonald's Happy Meal.

Although the present invention has been described with reference to a preferred embodiment and a particular application, the foregoing disclosure will enable those skilled in the art to realize additional applications and embodiments. For example, the preferred embodiment carton 100 can also function as a package or container for a beverage cup and a serving of nachos. Thus, the scope of the present invention is to be limited only to the extent of the claims that follow.

I claim:

1. A carton of a type suitable for temporary storage and transportation of at least one combination of food and beverage, comprising:

a rear panel;

a right side panel having a first edge joined to a first edge of said rear panel;

a front panel having a first edge joined to a second, opposite edge of said right side panel;

a left side panel having a first edge joined to a second, opposite edge of said front panel, and having a second, opposite edge joined to a second, opposite edge of said rear panel;

a bottom joined to lower edges of said rear panel, said right side panel, said front panel, and said left side panel;

a first top panel joined to an upper edge of said right side panel, wherein said first top panel extends between a forward end relatively nearer to said bottom and a rearward end relatively farther from said bottom;

a second top panel joined to an upper edge of said left side panel, wherein said second top panel extends between a forward end relatively nearer to said bottom and a rearward end relatively farther from said bottom, and overlapping portions of said first top panel and said second top panel cooperate to span an underlying portion of said bottom; and a forward top panel joined to an upper edge of said front panel, wherein said forward top panel extends upward and rearward from said front panel and underlies a portion of said overlapping portions to enclose a forward portion of the carton.

2. A carton according to claim 1, further comprising a connecting means for releasably connecting said first top panel and said second top panel relative to one another.

3. A carton according to claim 2, wherein said connecting means includes a distal flap on said second top panel, and said distal flap has a first width, defined between opposite sides of said distal flap, and said distal flap has a second, relatively lesser width, defined between terminal ends of generally transverse cuts into said opposite sides of said distal flap proximate said second top panel, and said connecting means further includes a generally linear slot formed in said first top panel and extending generally transverse relative to said distal flap, and said slot is at least as long as said first width of said distal flap, and said connecting means further includes an opening formed in said first top panel and bordered on one side by an intermediate portion of said slot and on an opposite side by an arcuate edge that intersects said slot in two discrete locations, thereby defining said intermediate portion, and said intermediate portion is approximately as long as said second width of said distal flap, and said slot receives said distal flap, and said arcuate edge of said opening cooperates with said transverse cuts to discourage withdrawal of said distal flap.

4. A carton according to claim 1, wherein said front panel and said forward top panel are integrally connected to one another, and at least one curved fold line extends therebetween.

5. A carton according to claim 1, wherein said forward top panel includes an intermediate panel and a third top panel, and said intermediate panel is integrally connected between said front panel and said third panel.

6. A carton according to claim 5, wherein a curved fold line extends between said third top panel and said intermediate panel.

7. A carton according to claim 6, wherein another curved fold line extends between said intermediate panel and said front panel.

8. A carton according to claim 7, wherein said curved fold line and said another curved fold line are concave relative to one another and join one another at respective opposite ends.

9. A carton according to claim 6, wherein forward edges of said first top panel and said second top panel are curved to substantially align with said curved fold line when overlapping said third top panel.

10. A carton according to claim 1, wherein said right side panel, said rear panel, and said left side panel extend from said bottom upward beyond uppermost edges of said first top panel and said second top panel and cooperate to provide an upwardly opening rearward portion of the carton suitable for storage of a beverage container.

11. A carton according to claim 10, further comprising a first distal flap extending rearward and upward from an uppermost edge of said right side panel, and a second distal flap extending rearward and upward from an uppermost edge of said left side panel, wherein said distal flaps cooperate with said right side panel, said rear panel, and said left side panel to provide said upwardly opening rearward portion of the carton.

12. A carton according to claim 11, wherein said distal flaps are designed to resiliently deflect relative to their respective top panels to receive and retain a beverage container.

13. A carton according to claim 1, wherein said rear panel is integrally connected to said right side panel, and said right side panel is integrally connected to said front panel, and said front panel is integrally connected to said left side panel, and said left side panel is integrally connected to an overlap panel, and said overlap panel is connected to said rear panel by means of adhesive.

14. A carton according to claim 1, wherein said rear panel, said right side panel, said front panel, said left side panel, said bottom, said first top panel, said second top panel, and said forward top panel are all integral portions of a continuous sheet of card stock.

15. A carton according to claim 1, wherein said bottom includes a separate bottom panel integrally connected to each of said rear panel, said right side panel, said front panel, and said left side panel, and each said separate bottom panel overlaps at least a portion of at least one other said separate bottom panel to form a substantially continuous bottom.

16. A carton made of cardstock and suitable for holding at least one food item and one beverage to be consumed by a consumer within one-half hour of purchasing same, comprising:

a rear panel;

a right side panel having a first edge joined to a first edge of said rear panel;

a front panel having a first edge joined to a second edge of said right side panel;

a left side panel having a first edge joined to a second edge of said front panel, and having a second edge joined to a second edge of said rear panel, wherein said rear panel, said right side panel, said front panel, and said left side panel cooperate to define a generally rectangular perimeter;

a bottom joined to lower edges of said rear panel, said right side panel, said front panel, and said left side panel;

a top extending between portions of said right side panel and said left side panel and effectively spanning a portion of said bottom; and an intermediate panel integrally connected between said front panel and at least a portion of said top, wherein said intermediate panel defines a plane that is skewed relative to planes defined by said rear panel, said right side panel, said front panel, said left side panel, said bottom, and said top, and a first arcuate fold line separates said front panel and said intermediate panel, and a second arcuate fold line separates said intermediate panel and said top.

17. A carton according to claim 16, wherein said top includes a first top panel integrally connected to said right side panel, a second top panel integrally connected to said left side panel, and a third top panel integrally connected to said intermediate panel, and first portions of said first top panel and said second top panel overlie said third top panel, and second portions of said first top panel and said second top panel are selectively interconnectable.

18. A carton made of cardstock and suitable for holding at least one food item and one beverage to be consumed by a consumer within one-half hour of purchasing same, comprising:

a rear panel;

a right side panel having a first edge joined to a first edge of said rear panel;

a front panel having a first edge joined to a second edge of said right side panel;

a left side panel having a first edge joined to a second edge of said front panel, and having a second edge joined to a second edge of said rear panel, wherein said rear panel, said right side panel, said front panel, and said left side panel cooperate to define a generally rectangular perimeter;

a bottom joined to lower edges of said rear panel, said right side panel, said front panel, and said left side panel;

a top extending between portions of said right side panel and said left side panel and effectively spanning a portion of said bottom, wherein said top includes a first top panel integrally connected to said right side panel, a second top panel integrally connected to said left side panel, and a third top panel which underlies said first top panel and said second top panel;

an intermediate panel integrally connected between said front panel and said third top panel, wherein said intermediate panel defines a plane that is skewed relative to planes defined by said rear panel, said right side panel, said front panel, said left side panel, said bottom, and said top, and an arcuate fold line separates said intermediate panel and said third top panel, and forward edges of said first top panel and said second top panel are curved to substantially align with said arcuate fold line.

* * * * *

UNITED STATES PATENT AND TRADEMARK OFFICE
CERTIFICATE OF CORRECTION

PATENT NO. : 5,605,279

DATED : February 25, 1997

INVENTOR(S) : David J. Adamek

It is certified that error appears in the above-identified patent and that said Letters Patent is hereby corrected as shown below:

On column 9, line 36 (claim 14), please insert --panel-- after the word "bottom".

Signed and Sealed this

Thirtieth Day of December, 1997

*Attest:*

Bruce Lehman

BRUCE LEHMAN

*Attesting Officer*

*Commissioner of Patents and Trademarks*